US010689793B2

(12) United States Patent
Glass et al.

(10) Patent No.: US 10,689,793 B2
(45) Date of Patent: Jun. 23, 2020

(54) DRYER LOCKER SYSTEM

(71) Applicant: Balt Designs, LLC, Waverly, OH (US)

(72) Inventors: Billy L. Glass, Waverly, OH (US); Ryan Clemmons, Piketon, OH (US); John Jason Foster, Piketon, OH (US)

(73) Assignee: Balt Designs, LLC, Waverly, OH (US)

( * ) Notice: Subject to any disclaimer, the term of this patent is extended or adjusted under 35 U.S.C. 154(b) by 86 days.

(21) Appl. No.: 15/898,249

(22) Filed: Feb. 16, 2018

(65) Prior Publication Data

US 2018/0237981 A1 Aug. 23, 2018

Related U.S. Application Data

(60) Provisional application No. 62/460,970, filed on Feb. 20, 2017.

(51) Int. Cl.

| | |
|---|---|
| ***F26B 25/06*** | (2006.01) |
| ***D06F 59/02*** | (2006.01) |
| ***A47L 23/20*** | (2006.01) |
| ***A47B 61/00*** | (2006.01) |
| ***F26B 21/00*** | (2006.01) |
| *D06F 59/04* | (2006.01) |
| *A47B 61/04* | (2006.01) |

(52) U.S. Cl.

CPC ..... *D06F 59/02* (2013.01); *A47B 61/003* (2013.01); *A47L 23/20* (2013.01); *F26B 21/001* (2013.01); *F26B 21/008* (2013.01); *A47B 61/04* (2013.01); *D06F 59/04* (2013.01)

(58) Field of Classification Search

CPC ..... D06F 59/02; D06F 59/04; F26B 21/001; F26B 21/008; A47B 61/003; A47B 61/04; A47L 23/20

USPC ..... 34/202, 201, 442, 413, 443

See application file for complete search history.

(56) References Cited

U.S. PATENT DOCUMENTS

| | | | | |
|---|---|---|---|---|
| 2,658,810 | A * | 11/1953 | Ellis | A47B 83/001 312/238 |
| 5,412,928 | A | 5/1995 | Reithel | |
| 5,862,606 | A | 1/1999 | Jannach | |
| 7,025,215 | B2 * | 4/2006 | Bain | A47G 25/0664 211/85.31 |
| 8,793,892 | B2 | 8/2014 | McLoughlin et al. | |
| 8,844,154 | B2 | 9/2014 | McLoughlin et al. | |
| 10,197,332 | B2 * | 2/2019 | Hinkey | F26B 21/001 |
| 2011/0074256 | A1 * | 3/2011 | Boice | A47B 81/00 312/213 |
| 2012/0186098 | A1 * | 7/2012 | Williams | D06F 59/02 34/240 |

(Continued)

*Primary Examiner* — John P McCormack

(74) *Attorney, Agent, or Firm* — Fay Sharpe LLP; James E. Scarbrough

(57) ABSTRACT

The disclosure relates to a dryer locker system for us with gear such as firefighting turnout gear including a housing having an interior region defined by a first sidewall, a second sidewall, a bottom wall, and a rear wall. An air blower is disposed on the bottom wall. An air duct is connected to an outlet of the air blower, such that the air blower supplies an air flow to the air duct. A jacket holder is rigidly mounted to the rear wall and projects into the interior region. The jacket holder is adapted to receive the air flow from the air duct. A pants holder is also rigidly mounted to the rear wall and projects into the interior region. The pants holder is also adapted to receive the air flow from the air duct.

18 Claims, 3 Drawing Sheets

(56) References Cited

U.S. PATENT DOCUMENTS

| | | | | |
|---|---|---|---|---|
| 2013/0180124 | A1 | 7/2013 | Durham | |
| 2014/0120821 | A1* | 5/2014 | Vignali | B60H 1/00564 454/76 |
| 2018/0105972 | A1* | 4/2018 | Smoots | F26B 21/001 |

* cited by examiner

DRYER LOCKER SYSTEM

CLAIM OF PRIORITY

This application claims priority to U.S. Provisional Application Ser. No. 62/460,970 filed on Feb. 20, 2017, which is incorporated in its entirety by reference herein.

BACKGROUND OF THE DISCLOSURE

The present disclosure relates to a locker system for storing protective gear. More specifically, it relates to an improved dryer locker system for storing and providing drying capabilities to turnout gear such as worn by firefighters. The locker system can also be used with other gear as well.

Turnout gear, also referred to as bunker gear, refers to the protective garments or gear worn by firefighters. Turnout gear generally includes, but is not limited to, a jacket, pants, helmet, and boots. The turnout gear is generally constructed of heavy, thick materials which ensure the safety of firefighters during firefighting tasks. However, these heavy and thick materials also provide little ventilation, causing the turnout gear to easily become wet and damp while in use by firefighters. In view of the nature of the usage and construction of turnout gear, it is preferred that after each usage the turnout gear can be stored in an area where the gear can dry to prevent growth of mildew, bacteria, fungus, etc., and to preserve the integrity of the turnout gear.

Some existing storage lockers are provided with a housing including a drying system, however, a problem with these systems is the turnout gear is generally indirectly mounted in the locker by the use of hangers, and the drying system is not incorporated within the hangers. Another problem is the use of hangers also does not provide a rigid mounting solution for handling the weight of turnout gear.

As such, there is a need to provide a storage locker which can be provided with a housing having a drying apparatus integrated with the apparatus for directly mounting the turnout gear.

Thus, an improved dryer locker system which allows for direct mounting and drying of turnout gear within a housing in combination with other related components is desired which overcomes the above mentioned difficulties and others while providing better overall results.

BRIEF DESCRIPTION OF THE DISCLOSURE

The present disclosure relates to a dryer locker system. More specifically, it relates to an improved dryer locker system which facilitates storage and drying of firefighting turnout gear. The disclosure relates to a dryer locker system for firefighting turnout gear, which includes a housing having an interior region defined by a first sidewall, a second sidewall, a bottom wall, and a rear wall. An air blower is disposed on the bottom wall and an air duct is connected to an outlet of the air blower so that the air blower supplies an air flow to the air duct. A jacket holder is rigidly mounted to the rear wall and projects into the interior region. The jacket holder is adapted to receive the air flow from the air duct. A pants holder is rigidly mounted to the rear wall and also projects into the interior region. The pants holder is also adapted to receive the air flow from the air duct.

In some particular embodiments of the firefighter dryer locker system, the housing can have a height of about 70 inches to about 75 inches, a depth of about 15 inches to about 20 inches, and a width of about 20 inches to about 25 inches.

The combination of these components located in or on a housing, including the air blower, air duct, jacket holder, and pants holder, is particularly unique, alone or in combination with additional components and aspects. For example, the jacket holder and the pants holder are both rigidly mounted to a mounting surface of the rear wall. The jacket holder can further include a pipe which provides a conduit for the air flow. The pipe includes an inlet connected to the air duct which receives the air flow and includes an elbow portion having two outlets. A nozzle is disposed on each outlet of the elbow portion. The elbow portion is operable to direct the air flow at an angle to a respective jacket sleeve of the turnout gear.

As another example, the pants holder can include a first and second pipe which each provide a conduit for the air flow. Each of the first and second pipe includes an inlet connected to the air duct adapted to receive the air flow and includes an elbow portion having an outlet. A nozzle is disposed on each outlet of the first and second pipe. Each elbow portion is operable to direct the air flow downward to a respective pant leg of the turnout gear.

Furthermore, a cover can be included which encloses the air blower, and the air blower can include an adjustable timer adapted to control the blower. A helmet holder can also be included, the helmet holder being rigidly mounted to the rear wall and projecting into the interior region. The helmet holder generally includes a plate adapted to fit within and support a helmet of the turnout gear. In addition, a glove holder can be included which is rigidly mounted to the rear wall and includes a first arm and a second arm. The first and second arms can each include one or more exhaust apertures operable to provide an additional air flow to a respective pair of gloves. The housing can further include one or more adjustable feet adapted to adjust a position of the housing.

In an additional example, the housing can include a mounting column rigidly attached to the rear wall. When a mounting column is included, the jacket holder and the pants holder are both rigidly mounted to mounting column. The mounting column can be provided with a hollow interior which comprises the air duct. In such a case, the mounting column can further include one or more exhaust apertures operable to provide an additional air flow to the housing. In addition, the jacket holder and the pants holder can also include one or more exhaust apertures operable to provide an additional air flow to a respective jacket and a respective pair of pants.

Another embodiment of the present disclosure is a dryer locker system for firefighting turnout gear which includes a plurality of housings. Each housing generally includes the components discussed above for an individual locker system. As such, the plurality of housings can each include, inter alia, an interior region defined by a first sidewall, a second sidewall, a bottom wall, and a rear wall. An air blower is disposed on the bottom wall and an air duct is connected to an outlet of the air blower so that the air blower supplies an air flow to the air duct. A jacket holder is rigidly mounted to the rear wall and projects into the interior region. The jacket holder is adapted to receive the air flow from the air duct. A pants holder is rigidly mounted to the rear wall and also projects into the interior region. The pants holder is also adapted to receive the air flow from the air duct. The plurality of housings can be arranged in any desired manner.

Still other embodiments of the disclosure will be apparent upon a reading and understanding of the following detailed disclosure.

BRIEF DESCRIPTION OF THE DRAWINGS

Embodiments of the present disclosure are described with reference to the following figures.

DETAILED DESCRIPTION OF THE DISCLOSURE

The present disclosure relates to a locker system that serves as a permanent place for safe gear storage such as firefighter gear with drying capabilities when needed. The disclosure relates to an improved locker design which provides a sturdy hanging system for heavy turnout gear such as firefighter gear as well as an incorporated fresh air drying system. The locker system of the present disclosure stores turnout gear in a ready-to-go fashion, and multiple lockers can be arranged in any desired manner to provide storage for many firefighters.

Figure 1:
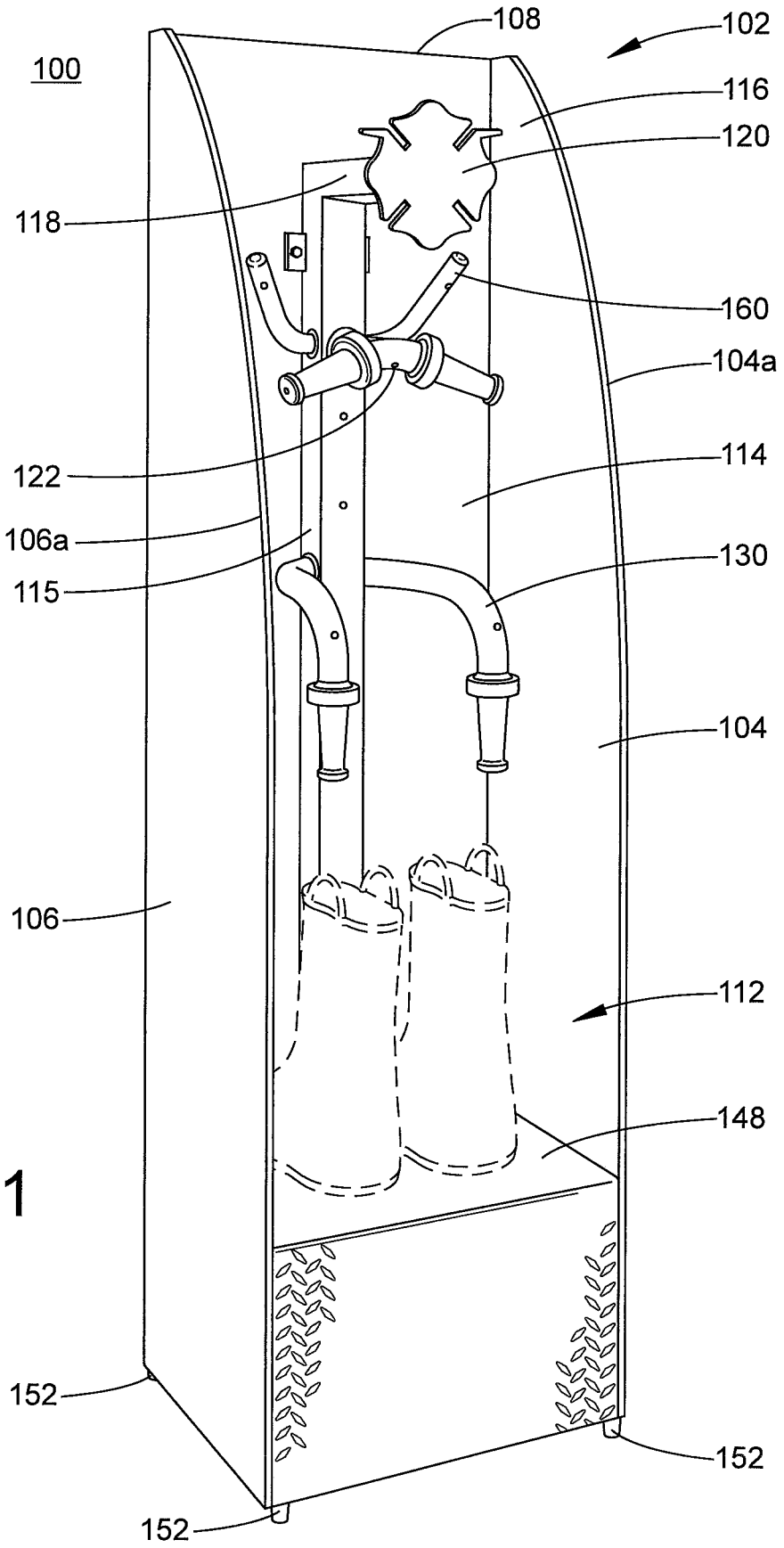
FIG. 1 is a perspective view of an exemplary embodiment of a dryer locker system according to the present disclosure.
Figure 2:
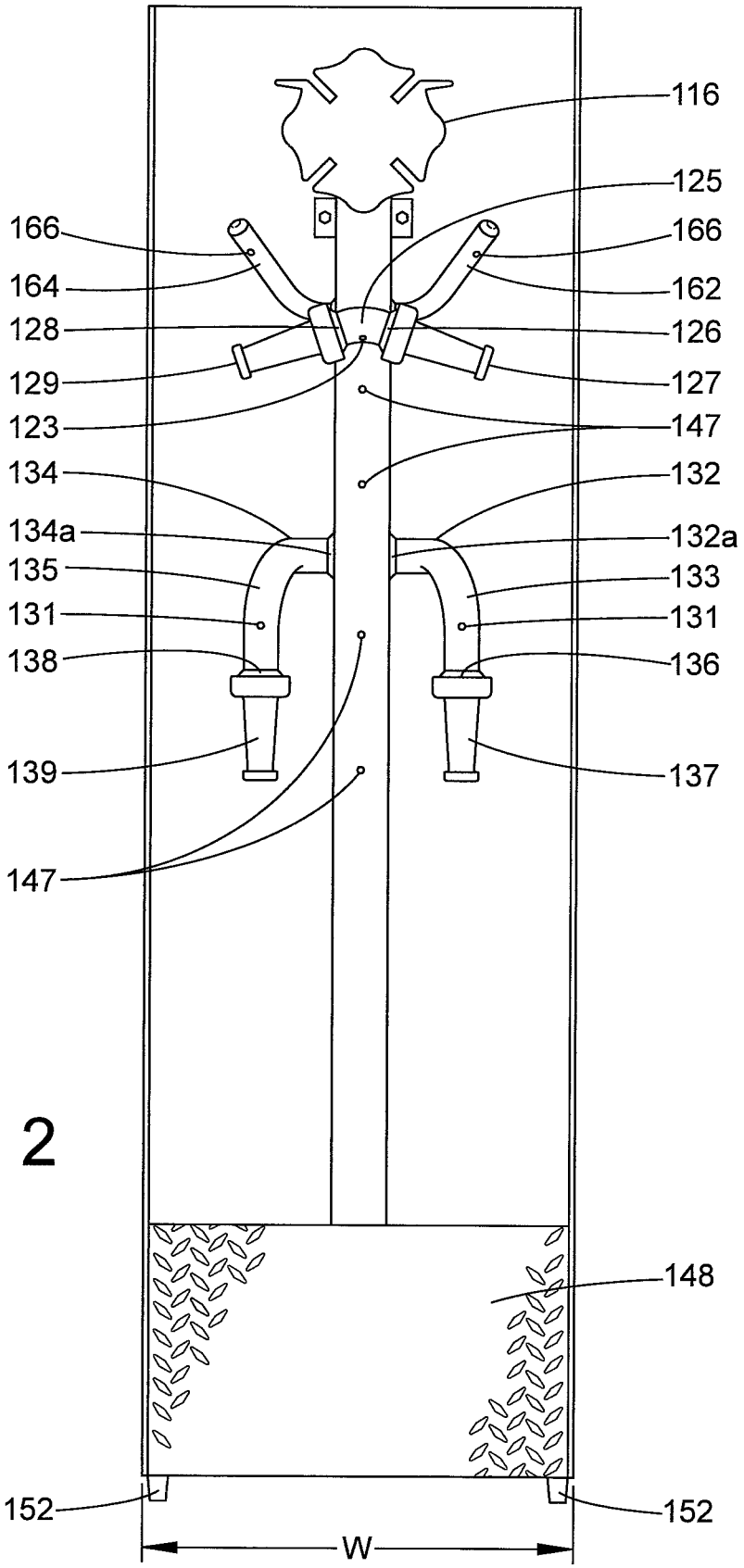
FIG. 2 is a front elevational view of the dryer locker system shown in FIG. 1.
Figure 3:
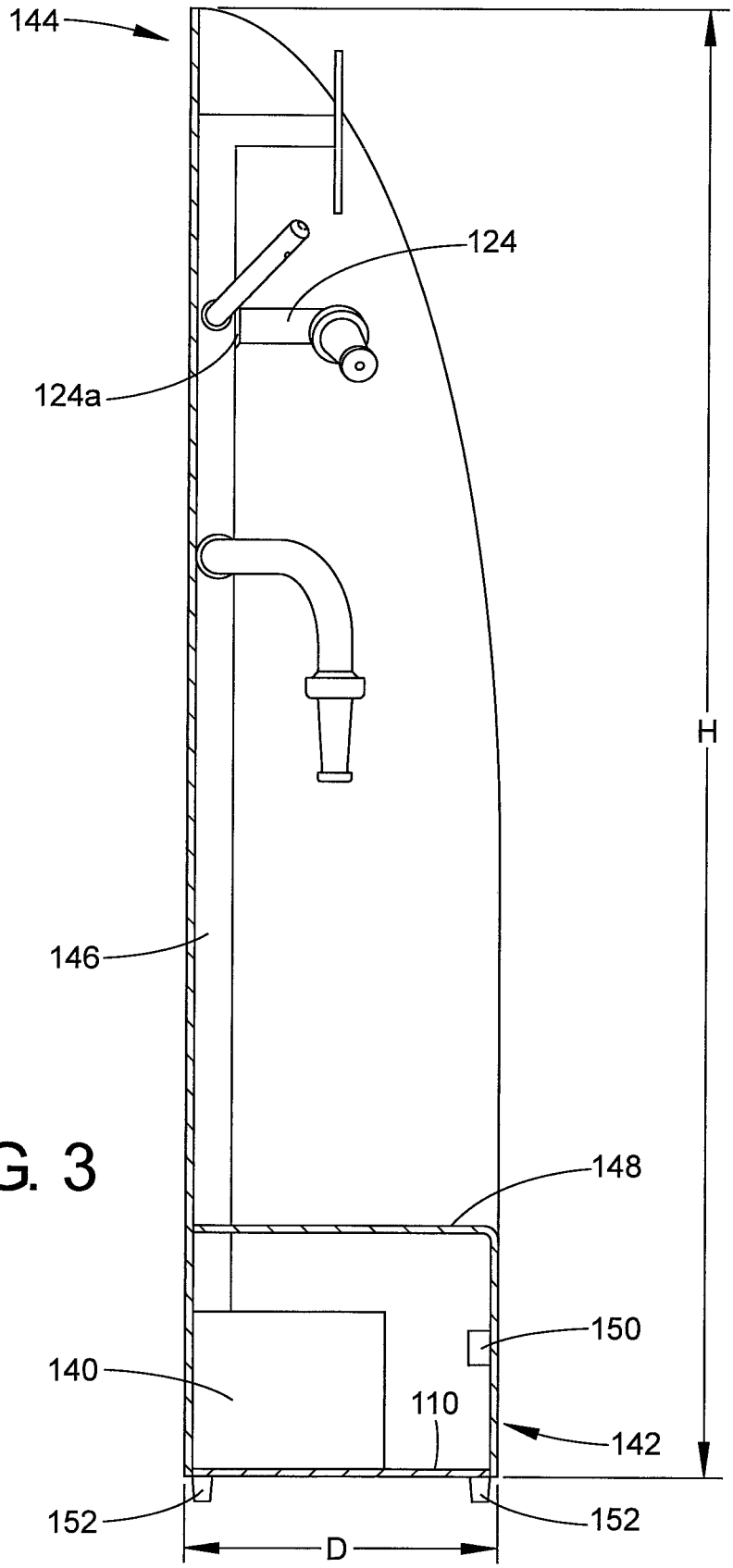
FIG. 3 is a cross-sectional side elevational view of the dryer locker system shown in FIG. 1.

Referring now to FIGS. 1-3, a dryer locker system 100 in accordance with a preferred embodiment of the disclosure is shown. Specifically, the dryer locker system 100 includes a housing 102 having an interior region 112 defined by a plurality of walls, including a first sidewall 104, a second sidewall 106, a rear wall 108, and a bottom wall 110 (FIG. 3). The housing 102 can be made from any suitable material providing a sturdy and durable construction, such as metal, wood, plastic, etc. The interior region 112 generally provides the area in which a protective garment, such as firefighter turnout gear (not shown), is stored.

The turnout gear can include a number of different garments or elements for protecting a firefighter, but generally includes a helmet, jacket, pants, and gloves. These garments or elements of the turnout gear should generally be stored in an area having adequate ventilation. As such, the first and second sidewalls 104, 106 can be provided with upper sloped edge portions 104*a* and 106*a* which slope in a direction toward the rear wall. These sloped edge portions 104*a* and 106*a* provide increased exposure of the interior region 112 to ambient air surrounding the housing, as well as provide for easier access to the interior region 112 compared to sidewalls having straight edges.

The housing 102 can also be provided with a one or more adjustable feet 152 disposed on a surface of the bottom wall 110 which generally faces the floor or ground surface on which the housing 102 is installed. The adjustable feet 152 are adapted to adjust a position of the housing 102 such that the housing remains level with respect to the floor or ground surface on which the housing is located. The adjustable feet 152 can be made from rubber to ensure a good grip with between the housing and floor or ground surface on which the housing is installed.

The housing 102 should generally be sized to adequately accommodate turnout gear stored in the housing. Referring to FIG. 3, in some particular embodiments, the housing 102 can have a height H of about 70 inches to about 75 inches, a depth D of about 15 inches to about 20 inches, and a width W (FIG. 2) of about 20 inches to about 25 inches. These dimensions are only exemplary, however, and it should be understood to those having skill in the art that the housing can have any suitable dimension which provides space for turnout gear of various sizes and provides for proper ventilation.

In order to store the various elements of the turnout gear within the interior region 112 of the housing 102, the rear wall 108 includes a mounting surface 114 which is exposed to the interior region. The rear wall 108 can optionally include a mounting column 115 which is rigidly attached thereto. The mounting column 115 is generally centrally located on the rear wall 108. In other words, the mounting column 115 is positioned such that the distance between the mounting column and the first side wall 104 and the distance between the mounting column and the second sidewall 106 are equal.

A helmet (not shown) of the turnout gear can be stored on a helmet holder 116, which is rigidly attached to the mounting surface 114 of the rear wall 108. The helmet holder 116 can also be rigidly attached to the rear wall 108 via the optional mounting column 115. The helmet holder 116 includes a post 118 which attaches to the mounting surface 114 or mounting column 115 on one end and projects into the interior region 112 of the housing 102 in a direction which is generally perpendicular to the mounting surface of the rear wall 108. A plate 120 is disposed the other end of the post 118 and has a configuration adapted to fit within and support the helmet of a corresponding set of turnout gear.

A jacket (not shown) of the turnout gear can be stored on a jacket holder 122, which is also rigidly attached to the mounting surface 114 of the rear wall 108 at a location which is generally below the helmet holder 116. The jacket holder 122 can also be attached to the rear wall 108 via the optional mounting column 115 at a location below the helmet holder 116. The jacket holder 122 can have a tube or pipe 124 (FIG. 3) which attaches to the mounting surface 114 or mounting column 115 on an inlet end 124*a*. The pipe 124 projects into the interior region 112 of the housing 102 in a direction which is generally perpendicular to the mounting surface of the rear wall 108. The other end of the pipe 124 includes an elbow portion 125 having two outlets 126 and 128. The pipe 124 acts as a conduit for the transference of air from the inlet end 124*a* of the pipe to the outlets 126 and 128, where the air is expelled. The elbow portion 124 is operable to direct the air flow at an angle which generally corresponds to the angle at which the sleeves of a turnout jacket are oriented when the jacket is placed on the jacket holder 122 for storage.

Nozzles 127 and 129 can be disposed on outlets 126 and 128, respectively. Nozzles 127 and 129 help to control the direction or characteristics (e.g., velocity) of an air flow that exits the outlets 126, 128 of the pipe 124. The jacket holder 122 can also include one or more exhaust apertures 123 located on any component of the jacket holder, such as the pipe 124 and/or elbow portion 125. In this regard, the pipe 124 also acts as a conduit for the transference of air to the one or more exhaust apertures 123 where the air is expelled. Thus, the one or more exhaust apertures 123 provide for additional air flow to the jacket placed on the jacket holder 122.

A pair of gloves (not shown) for the turnout gear can be stored on a glove holder 160, which is also rigidly attached to the mounting surface 114 of the rear wall 108 at a location generally adjacent the jacket holder 122 or between the jacket holder and the helmet holder 116. Such attachment locations for the glove holder 160 include the tube or pipe 124 of the jacket holder 122 or the sides of mounting column 115, for example. The glove holder 160 includes a first arm 162 and a second arm 164, each extending toward the first and second sidewalls 104, 106, respectively, and each oriented at an upward angle which is generally opposite to the angle of nozzles 127, 129. Each arm 162, 164 acts as a conduit for the transference of air to one or more exhaust apertures 166. When each glove in a pair is placed on a respective arm 162, 164, the one or more exhaust apertures 166 are operable to direct air flow into the interior region of each glove.

A pair of pants (not shown) of the turnout gear can be stored on a pants holder 130, which is also rigidly attached to the mounting surface 114 of the rear wall 108 at a location which is generally below the jacket holder 122. The pants holder 130 can also be attached to the rear wall 108 via the optional mounting column 115 at a location below the jacket holder 122. The pants holder 130 includes a first and second tube or pipe 132, 134 which are spaced apart from each other. The first and second pipe 132, 134 attach to the mounting surface 114 or mounting column 115 at respective inlet ends 132*a*, 134*a* and project into the interior region 112 of the housing 102 in a direction which is generally perpendicular to the mounting surface of the rear wall 108. The other ends of the pipes 132, 134 include elbow portions 133, 135, respectively, each having a corresponding outlet 136 and 138. The pipes 132, 134 act as a conduit for the transference of air from the inlet end 132*a*, 134*a* of the pipe to the outlets 136 and 138, where the air is expelled. The elbow portions 133, 135 are operable to direct the air flow at downward angle which generally corresponds to the angle at which the pant legs of a turnout pair of pants are oriented when the pants are placed on the pants holder 130 for storage.

Nozzles 137 and 139 can be disposed on outlets 136 and 138, respectively. Nozzles 137 and 139 help to control the direction or characteristics (e.g., velocity) of an air flow that exits the outlets 136, 138 of the pipes 132, 134. The pants holder 130 can also include one or more exhaust apertures 131 located on any component of the pants holder, such as the first and second pipes 132, 134 and/or elbow portions 133, 135. In this regard, the pipes 132, 134 also act as a conduit for the transference of air to the one or more exhaust apertures 131 where the air is expelled. Thus, the one or more exhaust apertures 131 provide for additional air flow to the pants placed on the pants holder 130.

Moreover, pants for turnout gear often include straps or suspenders to support the pants when being worn. The straps or suspenders can be placed over components of the jacket holder 122, such as the pipe 124, the elbow portion 125, and/or the nozzles 127, 129. In such an arrangement, the pant legs are still generally oriented at a similar angle as elbow portions 133, 135, such that the elbow portions are still operable to direct air flow downward and into the pant legs.

The rigid attachment of the helmet holder 116, the jacket holder 116, the glove holder 160, and the pants holder 130 to the rear wall 108 via mounting surface 114 or mounting column 115 advantageously provides a sturdy and durable storage option which resists the wear and tear of repeated placement and removal of an associated helmet, jacket, gloves, and pants. In this regard, any attachment means known by those having skill in the art to be suitable for rigid attachment can be used to mount the helmet holder, jacket holder, glove holder, and pants holder to the rear wall, such as nuts and bolts, screws, nails, welds, adhesives, etc., and the like.

In order to provide an air flow to the jacket holder 122, the glove holder 160, and the pants holder 130, an air blower 140 is provided. The air blower 140 is generally disposed on the bottom wall 110 of the housing 102 such that it is situated within the interior region 112. A cover 148 can optionally be included which encloses the air blower 140 and protects the air blower from debris (e.g., dirt, moisture, etc.) which may come from the turnout gear stored in the housing 102. The cover 148 also provides a surface on which the boots of the turnout gear can be placed as seen in FIG. 1. The air blower 140 also includes an electrical plug (not shown) for powering the air blower.

Air flow from the blower 140 is provided to the jacket holder 122 and pants holder 130 through an air duct 146, which is disposed within the rear wall 108 of the housing. The air duct 146 generally extends from a bottom portion 142 of the housing 102, where it is operably connected to an outlet (not shown) of the air blower 140, to a top portion 144. In other words, the air duct 146 generally spans a height of the rear wall 108, such that air can be delivered to any desired component that may be attached to the mounting surface 114 of the rear wall, such as the jacket holder 122, glove holder 160, and pants holder 130. In particular, the inlet 124*a* of the pipe 124 is connected to the air duct 146 to receive air flow from the blower 140. Each arm 162, 164 of the glove holder 160 is connected to the air duct 146 to receive air flow from the blower 140. The inlets 132*a*, 134*a* of the pipes 132, 134 are also connected to the air duct 146 to receive air flow from the blower 140. In this regard, pipes 124, 132, and 134, and arms 162, 164 all act as air conduits that provide for the transference of air from the air duct 146, into the inlets 122*a*, 132*a*, 134*a* and arms 162, 164, and out of the outlets 126, 128, 136, 138 and the one or more exhaust apertures 166. The air duct 146 can also include one or more exhaust apertures (not shown) which extend between the air duct and the back wall 108 to provide additional air flow to the housing 102 and to all pieces of turnout gear stored therein.

Alternatively, when the rear wall 108 includes the mounting column 115, the mounting column can be adapted to function as an air duct. That is, the mounting column 115 has a hollow interior which comprises the air duct. In this regard, similar to air duct 146, the mounting column 115 generally extends from the bottom portion 142 of the housing 102, where it is operably connected to an outlet (not shown) of the air blower 140, to a top portion 144. The mounting column 115 generally spans the height of rear wall 108 such that air can be delivered to any components attached to the mounting column, such as the jacket holder 122, glove holder 160, and pants holder 130. In particular, the inlet 124*a* of the pipe 124 is connected to the mounting column 115 to receive air flow from the blower 140. Each arm 162, 164 of the glove holder 160 is connected to the mounting column 115 to receive air flow from the blower 140. The inlets 132*a*, 134*a* of the pipes 132, 134 are also connected to the mounting column 115 to receive air flow from the blower 140. In this regard, pipes 124, 132, and 134, and arms 162, 164 all act as air conduits that provide for the transference of air from the mounting column 115, into the inlets 122*a*, 132*a*, 134*a* and arms 162, 164, and out of the outlets 126, 128, 136, 138 and the one or more exhaust apertures 166. The mounting column 115 can also include one or more exhaust apertures 147 positioned on various locations thereof, such as the front surface of the mounting column facing the turnout gear and/or the side surfaces of the mounting column which face the first and second sidewalls 104, 106. Thus, the one or more exhaust apertures 147 are operable to provide additional air flow to the housing 102 and to all pieces of turnout gear stored therein.

Because firefighting is a dangerous, physically demanding task, and because turnout gear is typically constructed of heavy, thick materials, the turnout gear often gets damp or wet while a firefighter is on duty. Accordingly, when it is desired to dry turnout gear, the jacket is placed on the jacket holder 122, each glove in a pair is placed over the arms 162, 164 of the glove holder 160, and the pants are placed on or positioned below the pants holder 130. In particular, a collar portion of the jacket can generally be placed over the elbow portion 125 of the jacket holder 122, such that the first and second air outlets 126, 127 and nozzles 127, 128 are at least partially received in the sleeves of the turnout jacket. A waist portion of the turnout pants can generally be placed over the first and second pipe 132, 134 of the pants holder 130, such that the first and second air outlets 136, 138 of the elbow portions 133, 135 are at least partially received in each pant leg of the turnout pants.

Alternatively, straps or suspenders of the turnout pants can be placed on a component of the jacket holder 122, such that the first and second air outlets 136, 138 of the elbow portions 133, 135 are at least partially received in each pant leg of the turnout pants. Moreover, boots of the turnout gear can be placed on top of the cover 148 and within or below the pant legs, such that the first and second air outlets 136, 138 of the elbow portions 133, 135 are operable to direct air flow into the interior region of each boot.

Once the turnout jacket, gloves, pants, and boots are positioned on the jacket holder 122, glove holder 160, pants holder 133, and cover 148, respectively, the air blower 140 can be turned on to supply an air flow to the air duct 146. The inlets 124*a*, 132*a*, 134*a* of the pipes 124, 132, 134 and the arms 162 164 of the glove holder 160 all being connected to the air duct 146, receive the air flow provided by the air blower 140. The pipes 124, 132, 134 and arms 162, 164, acting as air conduits, transfer the air flow from the air duct 146 to the outlets 126, 128, 136, 138 and the one or more exhaust apertures 166, where the air flow interacts with the turnout jacket, gloves, pants, and boots to speed the drying thereof.

The air blower 140 can be provided with an adjustable timer 150 that controls the duration at which the air blower operates. The adjustable timer 150 may be manually adjustable by a firefighter-user to a certain time period. In this regard, the firefighter or user can control the amount of time at which the air blower 140 operates to provide an air flow to the firefighter or user's turnout gear.

While the embodiment described above and shown in FIGS. 1-3 illustrates an individual firefighter locker system 100 with a single housing 102 and corresponding components, it should be noted that a plurality of housings could be provided. The plurality of housings can be arranged in any manner desirable to the end user, such as being arranged in a side by side manner (i.e., where a first side wall of a first housing and a second side wall of an adjacent housing abut each other, and so on for each subsequent housing), in a cluster or group, in a spaced manner where a space is included between adjacent housings, in a spaced manner where adjacent housings are interconnected via some other component (e.g., a bench), etc. In any event, the particular arrangement of the plurality of housings is not limited to the aforementioned examples and can include any desired arrangement. When a plurality of housings are provided, each housing is equipped with the components discussed above with respect to an individual locker system, without deviating from the scope of the present disclosure.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A dryer locker system, comprising:

a housing having an interior region defined by a first sidewall, a second sidewall, a bottom wall, and a rear wall;

an air blower disposed on the bottom wall;

an air duct connected to an outlet of the air blower, wherein the air blower supplies an air flow to the air duct;

a jacket holder rigidly mounted to the rear wall and projecting into the interior region, the jacket holder adapted to receive the air flow from the air duct; wherein the jacket holder further comprises a pipe which provides a conduit for the air flow, said pipe includes an inlet connected to the air duct which receives the air flow and an elbow portion having two outlets; and, a pants holder rigidly mounted to the rear wall and projecting orthogonally into the interior region, the pants holder adapted to receive the air flow from the air duct; and, a helmet holder rigidly mounted to the rear wall and projecting into the interior region.

2. The system of claim 1, wherein the jacket holder and the pants holder are both rigidly mounted to a mounting surface of the rear wall.

3. The system of claim 1, further comprising a mounting column rigidly attached to the rear wall, wherein the jacket holder and the pants holder are both rigidly mounted to said mounting column, and wherein the mounting column has a hollow interior which comprises the air duct.

4. The system of claim 3, wherein the mounting column further comprises one or more exhaust apertures operable to provide said air flow to the housing.

5. The system of claim 1, wherein the jacket holder and the pants holder further comprise one or more exhaust apertures operable to provide said air flow to a respective jacket and a respective pair of pants.

6. The system of claim 1, further comprising a nozzle disposed on each outlet of the elbow portion.

7. The system of claim 1, wherein the elbow portion is operable to direct the air flow at an angle to a respective jacket sleeve of turnout gear.

8. The system of claim 1, wherein the pants holder comprises a first and second pipe which each provide a conduit for the air flow.

9. The system of claim 8, wherein each of the first and second pipe includes an inlet connected to the air duct which receives the air flow and an elbow portion having an outlet, wherein the elbow portion is operable to direct the air flow downward to a respective pant leg of turnout gear.

10. The system of claim 9, further comprising a nozzle disposed on each outlet of the first and second pipe.

11. The system of claim 1, wherein the helmet holder includes a plate adapted to fit within and support a helmet of turnout gear.

12. The system of claim 1, further comprising a glove holder rigidly mounted to the rear wall and including a first arm and a second arm.

13. The system of claim 12, wherein the first and second arms each include one or more exhaust apertures operable to provide said air flow to a respective pair of gloves.

14. The system of claim 1, further comprising a plurality of housings.

15. The system of claim 1, further comprising one or more adjustable feet adapted to adjust a position of the housing.

16. The system of claim 1, wherein the housing has a height in the range of 70 inches to 75 inches, a depth in the range of about 15 inches to about 20 inches, and a width in the range of 20 inches to 25 inches.

17. A dryer locker system for use with firefighting turnout gear, comprising:

a housing having an interior region defined by a first sidewall, a second sidewall, a bottom wall, and a rear wall;

a helmet holder rigidly mounted to the rear wall and projecting into the interior region;

an air blower disposed on the bottom wall;

an air duct connected to an outlet of the air blower, wherein the air blower supplies an air flow to the air duct;

a jacket holder rigidly mounted to the rear wall and projecting into the interior region, the jacket holder comprises a pipe which provides a conduit for the air flow, said pipe includes an inlet connected to the air duct which receives the air flow and an elbow portion having two outlets, said jacket holder directs the air flow into a jacket of the turnout gear;

a glove holder rigidly mounted to the rear wall, the glove holder including a first arm extending upwardly toward the first sidewall and a second arm extending upwardly toward the second sidewall, wherein the first and second arms include one or more exhaust apertures adapted to direct the air flow from the air duct into a pair of gloves of the turnout gear;

a pants holder rigidly mounted to the rear wall and projecting orthogonally into the interior region, the pants holder adapted to receive the air flow from the air duct and direct the air flow into pants of said turnout gear;

an adjustable timer adapted to control the air blower; and, one or more adjustable feet adapted to adjust a position of the housing.

18. A dryer locker system, comprising:

a plurality of housings, each housing comprising:

an interior region defined by a first sidewall, a second sidewall, a bottom wall, and a rear wall;

an air blower disposed on the bottom wall;

an air duct disposed adjacent the rear wall and connected to an outlet of the air blower, wherein the air blower supplies an air flow to the air duct; a jacket holder comprises an elbow from which extends a first nozzle and a second nozzle which extend downwardly in opposite directions relative to the mounting column;

a glove holder positioned above said jacket holder, said glove holder comprises first and second arms with exhaust apertures which extend upwardly in opposite directions relative to the mounting column;

a jacket holder rigidly mounted to the rear wall and projecting orthogonally into the interior region, the jacket holder adapted to receive the air flow from the air duct; and, a pants holder rigidly mounted to the rear wall and projecting into the interior region, the pants holder adapted to receive the air flow from the air duct.

* * * * *